US007300229B1

(12) United States Patent
Fyfe et al.

(10) Patent No.: US 7,300,229 B1
(45) Date of Patent: Nov. 27, 2007

(54) REPAIR JACKET FOR PILINGS AND METHOD

(76) Inventors: Edward R. Fyfe, 6310 Nancy Ridge Rd., Suite 103, San Diego, CA (US) 92121-3209; Robert Joness Fyfe, 350 Lexington St., San Francisco, CA (US) 94110

( * ) Notice: Subject to any disclaimer, the term of this patent is extended or adjusted under 35 U.S.C. 154(b) by 0 days.

(21) Appl. No.: 11/282,375

(22) Filed: Nov. 18, 2005

(51) Int. Cl.
*E02D 5/60* (2006.01)
*E02D 31/00* (2006.01)

(52) U.S. Cl. ..... 405/216; 405/211

(58) Field of Classification Search ..... 405/211.1, 405/216, 211
See application file for complete search history.

(56) References Cited

U.S. PATENT DOCUMENTS

| | | | | |
|---|---|---|---|---|
| 2,470,149 | A * | 5/1949 | Derby | 405/216 |
| 4,023,374 | A | 5/1977 | Colbert et al. | |
| 4,068,483 | A | 1/1978 | Papworth | |
| 4,306,821 | A * | 12/1981 | Moore | 405/216 |
| 4,699,703 | A | 10/1987 | Norman | |
| 4,993,876 | A * | 2/1991 | Snow et al. | 405/216 |
| 5,591,265 | A * | 1/1997 | Tusch | 405/216 |
| 5,714,045 | A | 2/1998 | Lasa et al. | |
| 6,364,575 | B1 * | 4/2002 | Bradley et al. | 405/216 |
| 6,536,991 | B1 | 3/2003 | Trader | |
| 2003/0085482 | A1 * | 5/2003 | Sincock et al. | 264/32 |

FOREIGN PATENT DOCUMENTS

GB 2177148 A * 1/1987

* cited by examiner

*Primary Examiner*—Frederick L. Lagman
(74) *Attorney, Agent, or Firm*—Mary Jo Redman; Calif Tervo Palomar Patent

(57) ABSTRACT

Repair jacket is adapted for repairing or reinforcing elongate structures such as pilings, especially in marine environments. Jacket includes a cylindrical body of fiber-reinforced plastic (FRP) material that is about 0.5 to 3.5 inches greater in diameter than the piling. The body is wrapped around the piling and sealed. Centering/damping springs keep the body centered on the piling and damp the blows of waves so the body is not damaged. A bottom seal is a resilient tube within an abrasion-resistant tube attached to the bottom of the body for sealing the gap. The resilient tube is filled with expanding grout to create a rigid seal at the bottom of the gap. The gap volume between piling and cylindrical body is then filled with grout to permanently attach repair jacket to piling and repair the surface of the piling.

14 Claims, 1 Drawing Sheet

FIG. 1
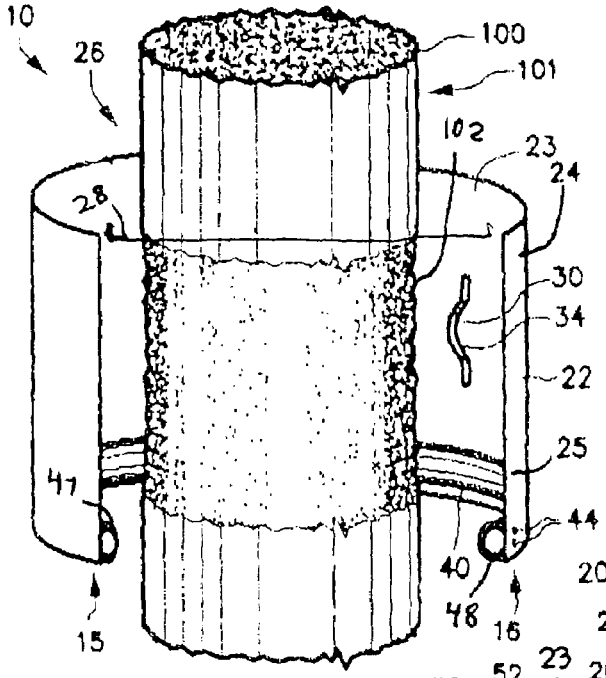
FIG. 2
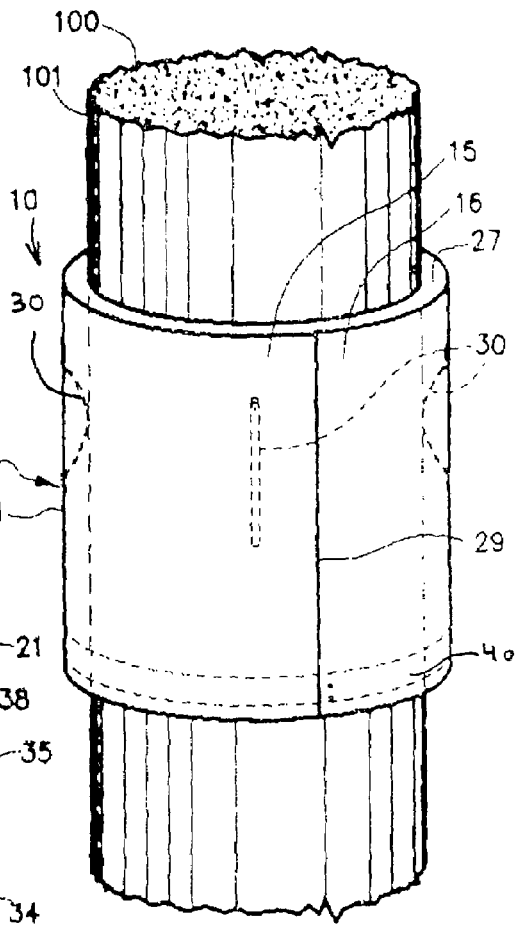
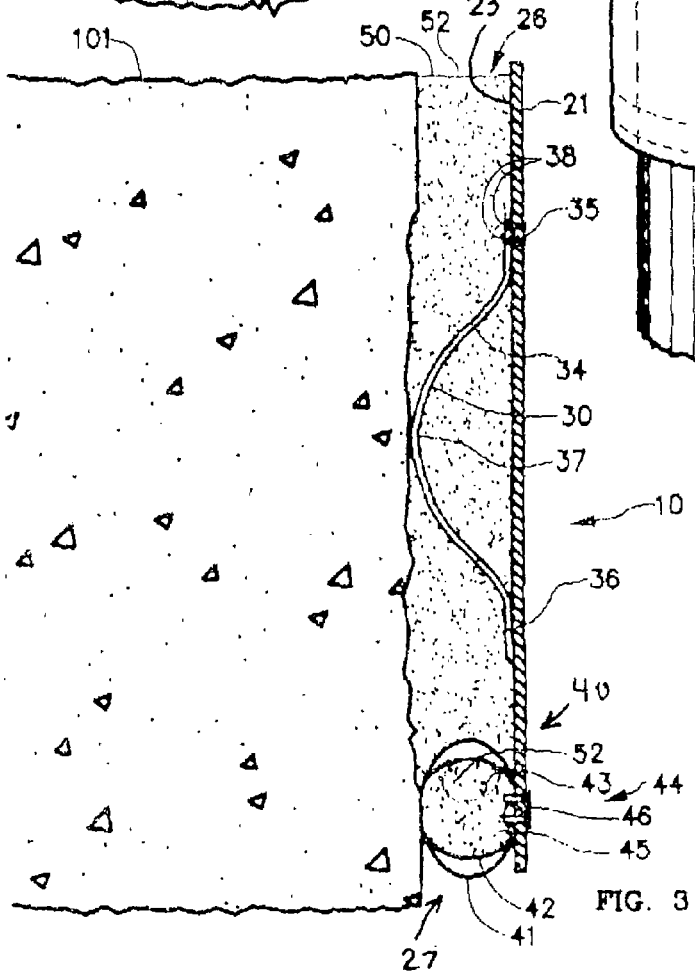
FIG. 3

REPAIR JACKET FOR PILINGS AND METHOD

FIELD OF THE INVENTION

This invention relates to repair devices for damaged structures and more particularly to a repair jacket for a column or piling.

BACKGROUND OF THE INVENTION

Structures are often repaired or reinforced by wrapping them in a composite of high-strength fiber in a polymer matrix. Sheets of textile fabric may be dipped in liquid resin then layered onto or wrapped around a structure. Sometimes panels of cured or partially cured fiber-reinforced plastic (FRP) are prepared in advance, then the panels are glued or mechanically attached to the surface of the structure.

For some applications it is more efficient to pre-fabricate FRP into a repair device with a shape similar to the surface of the structure. At the worksite, the roughly shaped repair device is quickly installed upon the structure. This approach is especially useful for elongate structures such as columns or pilings, and in difficult working conditions where mixing and using liquid resins is impractical.

Pier pilings set in water and extending above it are an example of elongate structures that often need to be repaired or reinforced, yet are difficult to work on. Structures partly under water suffer accelerated damage near the interface of water and air, for both mechanical and chemical reasons. Forces from breaking waves are strongest at the water's surface, boats typically strike a piling near the surface, and exposure to both water, especially sea water, and air drives electrochemical corrosion of metals and rotting of wood. Repairing a piling generally requires working near breaking waves and partially under the water.

Pre-fabricated repair jackets are thus often used to repair or reinforce pilings in marine environments. A jacket is wrapped or otherwise installed on the piling, then grout or epoxy is typically poured into the space between the jacket and the piling to affix the jacket permanently and rigidly to the piling. A problem with this repair method is that it is not always possible to grout the gap immediately after installing the jacket. During the time between installation and grouting, a jacket may be exposed to tides, breaking waves, and boat wakes. Because the ungrouted jacket can shift and rattle on the piling, the jacket can be itself damaged and need replacing before it is grouted.

Conventional repair jackets employ resilient material such as strips of rubber to protect the jacket from buffeting by waves and to form a bottom seal to prevent the grout from leaking out the bottom of the jacket. The rubbery materials used are sometimes torn or dislodged by wave action.

Therefore, there is a need for a repair jacket that is less susceptible to wave damage during the tine between preliminary installation and grouting. There is further a need for a repair jacket that can be easily installed by a worker who remains above the surface of the water. There is a need for a repair jacket with a robust bottom seal that is not torn or deformed by wave or tidal forces.

SUMMARY OF THE INVENTION

The present invention is a repair jacket for strong and efficient repair or reinforcement of damaged structures, especially columns and pilings. The jacket is a sheath of fiber-reinforced plastic, preformed on a mandrel, with a tubular bottom seal along the bottom edge and centering/damping springs around the inside. The sheath is designed to be larger in diameter than the piling to be repaired. The bottom seal is preferably a two-ply tube, including a rubbery inner tube-like channel and an outer abrasion-resistant layer.

The ends of the jacket are wrapped around the damaged portion of a piling and sealed together. The ends of the tubular bottom seal are connected so as to form a continuous torus. A circular gap of 0.5 to 3.5 inches remains between the jacket and the piling. The centering/damping springs keep the jacket centered on the piling and damp the lateral forces from waves crashing against the jacket. The centering/damping springs prevent the jacket from being ripped or dislodged by waves in the hours or days before final attachment.

The bottom seal is filled with expanding grout to make it rigid and also to seal it firmly against the piling. Then more grout is pumped or otherwise dispensed into the gap between the jacket and the piling. The bottom seal holds the gap grout from leaking out the bottom of the jacket. This grout permanently attaches the jacket to the piling and makes the jacket rigid. The rigid grout and tough FRP jacket combine to restore the piling to its nominal dimensions and prevent further erosion.

Other features and many attendant advantages of the invention will become more apparent upon a reading of the following detailed description together with the drawings wherein like reference numerals refer to like parts throughout.

BRIEF DESCRIPTION OF THE DRAWINGS

FIG. 1 is a perspective environmental view of a repair jacket opened for installation on a damaged piling.

FIG. 2 is a front perspective view of the repair jacket of FIG. 1 installed upon the damaged piling.

FIG. 3 is a sectional, cut-away view of the repair jacket of FIG. 2 installed on the piling.

DETAILED DESCRIPTION OF THE INVENTION

FIG. 1 is a perspective environmental view of a repair jacket 10 opened for installation on a damaged portion 102 of a column 100 such as piling 101. FIG. 2 is a front perspective view of repair jacket 10 installed upon the damaged piling 101.

It is typical for a piling 101 that is partially submerged in water to be heavily damaged in a band a few feet above the mean high tide level to just below the mean low tide level. Repair jacket 10 includes a body 20 including generally cylindrical sheath 21 of fiber-reinforced plastic (FRP). Repair jacket 10 may be modified easily to suit many applications, including various elongate structures such as bridge columns, buttresses, beams, or freeway overpass support columns, as well as lake or marine pilings. Repair jacket 10 is most simply described and illustrated as having a circular transverse cross-section, but repair jacket 10 may be square, rectangular, or polygonal, as needed to fit various structures, without sacrificing the ease of manufacture and use, or any other of its benefits. Repair jacket 10 may alternatively be of other suitable materials, such as steel, ABS, and so on.

Sheath 21 is preferably formed by wrapping sheets of high-strength textile material, such as fiberglass or graphite, wetted with a resin such as epoxy or polyurethane precursor, around a mandrel (not shown) that has the general shape as the piling 101 to be repaired and a diameter typically three to seven inches greater than the diameter of piling 101. After the resin is cured, sheath 21 is released form the mandrel by slitting an opening 28, creating a first end 15 and a second end 16 on either side of opening 28. Opening 28 is stretched wide enough that sheath 21 can be removed from the mandrel. Because the resin used to form sheath 21 typically shrinks during curing, after sheath 21 is removed from the mandrel, sheath 21 relaxes to a diameter smaller than that of the mandrel and first end 15 overlaps second end 16 slightly. Sheath 21 thus forms a hollow cylinder defining central chamber 26 and including an outer face 22, inner face 23, top 24, and bottom 25.

Sheath 21 as shown in FIG. 1 was formed over a cylindrical mandrel. Sheath 21 is sufficiently flexible that it can be used in a repair jacket 10 for repairing cylindrical pilings 21 or columns 100 that are hexagonal or octagonal. To pre-fabricate a repair jacket 10 for repairing a square column 100, a mandrel that is square in cross-section would be used and opening 28 would typically be slit along one of the vertices. In this description and in the claims, body 20 and sheath 21 are most often referred to as "generally cylindrical" and as having a diameter; however, this should be understood to include other geometrical forms, such as square, rectangular, or octaganal prisms, in which case, "diameter" of body 20 or sheath 21 should be understood as meaning the longest internal distance perpendicular to the longitudinal axis. Column 100 and piling 101 may similarly be understood as having a shape somewhat different from cylindrical.

FIG. 2 is a front perspective view of repair jacket 10 of FIG. 1 preliminarily installed upon damaged piling 101. FIG. 3 is a sectional, cut-away view of repair jacket 10 of FIG. 2 fully installed on piling 101.

Body 20 includes centering/damping means 30 attached to inner face 23 for maintaining body 20 generally concentric to piling 101 and with a uniform gap between body 20 and piling 101 during installation of repair jacket 10; and for damping lateral impulsive forces, such as from waves, during installation of jacket 10.

In the preferred embodiment illustrated, centering/damping means 30 is a plurality of springs, such as at least three bow springs 34 spaced around the inside circumference of inner face 23. Bow springs 34 each include a first end, such as attached end 35, a second end, such as free end 36, and a central bow 37 therebetween. Attached end 35 is typically a flange structure that is disposed parallel to and in contact with inner face 23 and attached to inner face 23 by suitable means, such as adhesive or screws 38. Free end 36 may be a similar flange structure that is parallel to, but not attached to, inner face 23, or free end 36 may simply be the unflanged tip of central bow 37. Free end 36 may be initially disposed in contact with, or up to 0.75 inches from, inner face 23.

Bow springs 34 may be fabricated from FRP material or may be of springy non-corroding metal, such as thin strips of marine grade stainless steel. When lateral force is applied to central bow 37, central bow 37 is made flatter and bow spring 34 increases in length from first attached end 35 to second free end 36. When the force is removed, bow spring 34 returns to its nominal shape.

Central bow 37 is generally in the range of 0.5 to 3.5 inches in height, with 2 inches being the nominal value. Central bow 37 may be curved throughout its length, or it may have a flat centermost portion (not shown). The purpose of bow springs 34 will be discussed more fully below.

Body 20 further includes a bottom seal 40 attached to bottom 25 of inner face 23. Bottom seal 40 is generally a hollow, resilient, abrasion-resistant tube having an interior channel 43. Bottom seal 40 preferably includes a dual-layer structure, as shown in the preferred embodiment of FIG. 3. Tough outer layer 41 is a flexible tube of abrasion resistant material, such as used for firefighting hose. Inside tough outer layer 41 is resilient tube 42, having a lengthwise interior chamber 43. Resilient tube 42 may be of synthetic rubber or other suitable material. Bottom seal 40 may alternatively consist of a single tube fabricated of a material that is sufficiently resilient to form a good seal against piling 101 and tough enough to withstand large waves after preliminary installation.

Preferably, there are seal ports 44, such as grout inlet port 45 and displaced fluid escape port 46, to provide means for filling bottom seal 40 with filler, such as grout, so as to seal between sheath 21 and piling 101. Seal ports 44 pierce resilient tube 42 and tough outer layer 41, and extend through holes in sheath 21 to be available on the outside of repair jacket 10 after preliminary installation. Seal ports 44 are preferably closeable.

The method of using repair jacket 10 includes three main processes, which will be set forth in greater detail below. First, body 20 is assembled by attaching bow springs 34 and bottom seal 40 to sheath 21. This step may be done in a shop, on the work site near piling 101, or adjacent piling 101, such as on a scaffold above the water surface. Second, body 20 is preliminarily installed upon piling 101. Opening 28 is stretched wide enough to allow passage of piling 101 into central chamber 26. Opening 28 is sealed by sealing means 29, described below, to form a generally cylindrical sleeve around piling 101. The two open ends of bottom seal 40 are attached together to create a torus with continuous interior channel 43. Third, repair jacket 10 is rigidified and permanently installed on piling 101 by being filled with filler material 50 in two steps. Initially, interior channel 43 is filled to create a snug seal between piling 101 and inner face 23, then gap volume 27 between inner face 23 and piling 101 is filled with filler material 50.

The three processes of repair will now be disclosed in greater detail. The first process of assembling body 20 may be modified as needed to suit different sizes or shapes of piling 101. A suitable size and shape of sheath 21 is selected such that the gap between inner face 23 and piling 101 is 0.5 to 3.5 inches, that is, the inside diameter of sheath 21 after opening 28 is sealed is typically 0.25 to 1.75 inches greater than the nominal (undamaged) diameter of piling 101.

Bow springs 34 are attached to inner face 23. For a piling 101 of up to about 30 inches diameter, two or three bow springs 34 are used, spaced roughly equally around inner face 23. To repair a larger piling 101, four or more bow springs may be used. Only first attached end 35 is attached to inner face 23, by any suitable means including adhesive or screws. Second free end 36 is left unattached, either lightly in contact with inner face 23 or spaced away from inner face 23 up to about 0.5 inch. Generally, it is preferable that first attached end 35 be disposed closer to top 24 of sheath 21 than is second free end 36, so that gravity does not create a torque on the attachment of first attached end 35. Centering/damping means may be other suitable types of spring as are well-known to one skilled in the art, such as a standoff pin (not shown) biased toward the center of central chamber 26 by a coil spring coaxial with the standoff, or a leaf-type spring (not shown) attached at its center and with two free ends extending upward from inner face 23.

Bottom seal 40 is then attached to sheath 21. In the preferred embodiment illustrated in the drawings, a length of firefightinig hose material the same length as the circumference of sheath 21 is attached to bottom 25 of sheath 21 by suitable means, such as by adhesive or by screws 38 that are slightly shorter than the combined thicknesses of sheath 21 and one wall of the firefighting hose material. This hose material forms tough outer layer 41.

The hose material may be slit along its length before being attached to bottom 25. In this case, screws 38 are inserted into the interior of the hose material, that is, tough outer layer 41, and screwed through the wall of tough outer layer 41 that is in contact with bottom 25 and into bottom 25. Tough outer layer 41 is typically attached such that the lengthwise slit is oriented toward top 24 or 180 degrees away from top 24, that is, so that the slit does not face directly inward toward central chamber 26. The next step is then to insert resilient tube 42 inside tough outer layer 41 by urging tube 42 through the slit.

Alternatively, tough outer layer 41 may be attached to bottom 25 without being slit along its length. In this case, screws 38 are started in outer face 22 of bottom 25 and screwed inwardly through outer face 22 and tough outer layer 41. In this case, it is preferable that resilient tube 42 be inserted into tough outer layer 41 before attaching tough outer layer 41 to bottom 25. In either case, adhesive, such as epoxy, or other suitable attachment means may alternatively be used to attach tough outer layer 41 to bottom 25.

Resilient tube 42 includes two seal ports 44, such as filler port 45 and escape port 46. Seal ports 44 are preferably closeable. As resilient tube 42 is inserted into tough outer layer 41, seal ports 44 are aligned with and pressed through corresponding holes in tough outer layer 41 and sheath 21, such that interior channel 43 is in fluid communication with the exterior of body 20 when seal ports 44 are open.

In the second part of installation, body 20 is wrapped around piling 101, either directly around damaged portion 102 or optionally above it, if damaged portion 102 is partly or completely under water. Due to the springiness of sheath 21, as mentioned above, opening 28 tends to spontaneously close such that body 20 retains itself generally in place around piling 101.

Resilient tube 42 is at this point a length of tube bent generally into an incomplete hoop with a first open end 47 and second open end 48. Next, the two ends 47,48 are attached together so as to form tube 42 into a closed torus. Ends 47,48 are attached such as by applying adhesive to the outer portion of first end 47, then gathering or pleating first end 47 so that it can be inserted into second end 48. The adhesive-coated first end 47 will adhere to the inside of second end 48 due to the resilience of tube 42 causing gathered first end 47 to spring, back to its tubular shape inside second end 48. To assure a complete seal, air may be introduced into resilient tube 42 through filler port 45, keeping escape port 46 closed, to press the adhesive-coated portion firmly against the inside of the other end of tube 42. Only sufficient air to restore the original cylindrical shape of resilient tube 42 may be introduced, so as to avoid overly distending resilient tube 42.

After resilient tube 42 is sealed to form a continuous torus, the ends of tough outer layer 41 are attached together similarly. Because it is less important that tough outer layer 41 be fluid-tight, the ends of tough outer layer 41 are attached together as an adhesive butt joint.

Sealing means 29 are then used to seal opening 28 such that body 20 forms a continuous sleeve around piling 101. Sealing means 29 may consist of attachment means such as adhesive, screws, or pop rivets. First end 15 and second end 16 may be adapted to enhance sealing, such as by tapering the ends 15, 16 to allow a smooth lap joint, or by shaping ends 15, 16 such that ends 15, 16 cooperate to latch together mechanically. Sealed opening 28 may be further reinforced or smoothed, such as by overlaying an additional panel of FRP material (not shown).

During the time that body 20 is preliminarily installed, but not yet infilled with filler material 50, body 20 would be vulnerable to damage by waves or other forces without centering/damping means 30. It has been found that jacket bodies without centering/damping means 30 can be torn or bottom seal 40 can be damaged or torn off by the action of waves and tide. Because gap volume 27 has not yet been filled with filler material 50, body 20 has free play to rattle and twist upon piling 101 and be abraded by roughness of damaged portion 102. It is not uncommon for a preliminarily installed body 20 to remain in position for two or three days before being filled, rigidified, and permanently attached to piling 101 by filler material 50. To prevent damage during this time, centering/damping means 30 are included in repair jacket 10.

Centering/damping means 30, such as bow springs 34, maintain body 20 upright on piling 101 with an equal gap around the circumference of piling 101. When a wave or floating object strikes body 20, bow springs 34 are deflected such that central bow 37 is flattened and second free end 36 slides vertically along inner face 23. The deflection of bow springs 34 absorbs the lateral force, then releases it harmlessly as bow springs 34 spring back to their original geometry. Bow springs 34 as described herein have been found to prevent wave damage to body 20 when used in test installations. Bottom seal 40 helps with maintaining body 20 centered upon piling 101, but is not able to sufficiently dampen wave forces.

The third and final process of installation of repair jacket 10 is filling interior channel 43 and gap volume 27 with filler material 50, preferably a solidifiable fluid that expands during solidification, such as expanding grout 52 or a foaming polymer. After body 20 is fully sealed, seal ports 44 are opened. Filler port 45 is connected to a source (not shown) of expanding grout 52. Sealed body 20 is now moved into place around damaged portion 102, if it is not already there.

Grout 52 is introduced into interior channel 43, pressurized by gravity, compressed air, or by a suitable pump. Fluid displaced by grout 52, such as air or water, escapes through escape port 46. Sufficient grout 52 is added to interior channel 43 that resilient tube 42 is distended enough to cause tough outer layer 41 to touch piling 101 at all points along the circumference of piling 101, which may be determined by observation or by previous calculation. The tubing or other means used to provide grout 52 to filler port 45 is either detached from filler port 45 or else left attached. If filler port 45 is farther than arm's reach under the surface of water, it may be found preferable to sacrifice the length of tubing rather than to have a diver retrieve it. Expansion of grout 52 during set-up will further compress bottom seal 40 between bottom 25 and piling 101. Other filler materials 50, such as epoxy or polyurethane, may be used in place of expanding grout 51, provided resilient tube 42 is filled to a greater initial pressure. More careful observation of the distension of resilient tube 42 is required in this case.

Grout 52 is also used to fill gap volume 27 between sheath 21 and piling 101. Grout 52 may be introduced into gap volume 27 through an optional grout port (not shown) near bottom 25 and above bottom seal 40. Alternatively, grout 52 is introduced through a tremi tube that is withdrawn as the level of grout 52 rises. In either case, an escape port is typically not needed because air or water being displaced escapes from gap volume 27 by rising through the open top of gap volume 27. It is also possible to simply pour grout 52 into the top of gap volume 27; however, simple pouring is more likely to result in pockets of water or air being trapped within grout 52, which would weaken repair jacket 10. As grout 52 solidifies and expands, grout 52 contacts the surface of piling 101 completely and repairs or reinforces it. Also, jacket 10 is stressed in tension by the expansion, further stiffening jacket 10.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A repair jacket for repairing a piling, including:

a generally cylindrical body, having a longitudinal axis and including:

an outer face;

an inner face;

a top; and a bottom; and a lengthwise opening from said top to said bottom;

centering/damping means attached to said body; for maintaining said body generally concentric to the piling and with a substantially uniform gap between said body and the piling; and for damping lateral impulsive forces against said body during installation of said jacket; and a bottom seal attached to said bottom of said body for sealing between the piling and said body; such that said bottom seal is adapted to cooperate with said inner face to support filler material for filling the gap between the piling and said inner face when said jacket is installed upon the piling and said opening is sealed; said bottom seal comprising:

a flexible tube defining an interior channel for accepting filler material; including:

a filler port piercing said flexible tube for accepting filler material into said interior channel; and an escape port piercing said flexible tube for allowing displaced fluid to escape from said interior channel.

2. The repair jacket of claim 1, wherein said bottom seal comprises:

a flexible resilient inner layer; and an abrasion-resistant outer layer for contacting the piling.

3. The repair jacket of claim 1, said bottom seal further including:

an abrasion-resistant outer layer for surrounding and protecting said flexible tube.

4. A repair jacket for repairing a piling, including:

a generally cylindrical body, having a longitudinal axis and including:

an outer face;

an inner face;

a top; and a bottom; and a lengthwise opening from said top to said bottom;

centering/damping means attached to said body; for maintaining said body generally concentric to the piling and with a substantially uniform gap between said body and the piling; and for damping lateral impulsive forces against said body during installation of said jacket; and a bottom seal attached to said bottom of said body for sealing between the piling and said body: such that said bottom seal is adapted to cooperate with said inner face to support filler material for filling the gap between the piling and said inner face when said jacket is installed upon the piling and said opening is sealed said centering/damping means comprising:

a plurality of springs attached to said inner face such that said springs bias said body away from the piling such that said body is maintained concentric to the piling; and such that the gap between said piling and said inner face is of generally equal width around the perimeter of the piling; and such that said springs damp energy from waves impacting said repair jacket during installation of said jacket upon a piling.

5. The repair jacket of claim 4, said plurality of springs comprising:

at least three bow springs spaced around said body; said bow springs including:

a first attached end for attachment to said jacket body;

a second free end disposed adjacent said jacket body and not attached to said body; and a bow portion between said first attached end and said second free end, adapted for deflection by a force normal to said longitudinal axis of said body and return to nominal dimensions upon removal of the force.

6. The repair jacket of claim 5, said bow springs consisting of FRP material formed so as to have a bow height of 0.5 to 3.5 inches.

7. In combination:

an elongate piling; including:

a portion in need of repair; including:

an outward-facing surface; and a longitudinal axis; and a repair jacket for repairing said piling; including:

a elongate body wrapped around said portion of said piling such that a gap remains between said body and said outward-facing surface; including:

an outer face;

an inner face defining a hollow chamber for accepting said portion of said piling;

a top;

a bottom; and centering/damping means attached to said body; for spacing said inner face apart from said outward-facing surface and maintaining said body generally concentric to said longitudinal axis of said piling; and for damping lateral impulsive forces during installation of said jacket;

said centering/damping means comprising:

a plurality of springs attached to said inner face such that said springs damp forces from waves impacting said repair jacket during installation of said repair jacket; and a bottom seal attached to said bottom of said body for sealing between said piling and said body; said bottom seal comprising:

a closed tube defining an interior channel adapted for accepting filler material and wherein:

said inner face and said bottom seal cooperate with said outward-facing surface of said portion of said piling to define a gap volume adapted for receiving filler material;

and wherein: said bottom seal and said body are adapted to maintain the filler material within said gap volume.

8. The combination of claim 7, wherein said bottom seal comprises:

a flexible resilient inner layer; and an abrasion-resistant outer layer for contacting said piling.

9. The combination of claim 7, said bottom seal comprising:

a flexible closed tube defining an interior channel; and said closed tube is adapted to expand upon filling such that said bottom seal is compressed between said bottom of said body and said outward-facing surface of said portion of said piling.

10. The combination of claim 7, wherein said gap volume has a radial thickness in the range of 0.5 to 3.5 inches.

11. In combination:

an elongate piling; including:

a portion in need of repair; including:

an outward-facing surface; and a longitudinal axis; and a repair jacket for repairing said piling; including:

a elongate body wrapped around said portion of said piling such that a gap remains between said body and said outward-facing surface; including:

an outer face;

an inner face defining a hollow chamber for accepting said portion of said piling;

a top;

a bottom; and centering/damping means attached to said body; for spacing said inner face apart from said outward-facing surface and maintaining said body generally concentric to said longitudinal axis of said piling; and for damping lateral impulsive forces during installation of said jacket;

a bottom seal attached to said bottom of said body for sealing between said piling and said body; said bottom seal comprising:

a flexible closed tube defining an interior channel; and said closed tube is adapted to expand upon filling such that said bottom seal is compressed between said bottom of said body and said outward-facing surface of said portion of said piling and wherein:

said inner face and said bottom seal cooperate with said outward-facing surface of said portion of said piling to define a gap volume adapted for receiving filler material; and wherein: said bottom seal and said body are adapted to maintain the filler material within said gap volume, said flexible closed tube including:

a filler port piercing said closed tube for filling said interior channel with filler material; and an escape port piercing said closed tube for allowing displaced fluid to escape from said interior channel.

12. A repair jacket for repairing a piling, including:

a generally cylindrical body, having a longitudinal axis and including:

an outer face;

an inner face;

a top; and a bottom; and a lengthwise opening from said top to said bottom;

centering means attached to said body; for maintaining said body generally concentric to the piling and with a substantially uniform gap between said body and the piling;

damping means attached to said body, for damping lateral impulsive forces against said body during installation of said jacket; said damping means comprising:

a plurality of springs attached to said inner face such that said springs damp forces from waves impacting said repair jacket during installation of said repair jacket; and a bottom seal attached to said bottom of said body for sealing between the piling and said body; including:

a flexible resilient closed tube defining an interior channel adapted for accepting filler material;

said bottom seal being adapted to cooperate with said inner face to support filler material for filling the gap between the piling and said inner face when said jacket is installed upon the piling and said opening is sealed.

13. The repair jacket of claim 12, said bottom seal further including:

an abrasion-resistant outer layer for contacting the piling.

14. The repair jacket of claim 12, said plurality of springs comprising:

at least three bow springs spaced around said body; each said bow spring including:

a first attached end for attachment to said jacket body;

a second free end disposed adjacent said jacket body and not attached to said body; and a bow portion between said first attached end and said second free end, adapted for deflection by a force generally normal to said longitudinal axis of said body and return to nominal dimensions upon removal of the force.

* * * * *